US005160876A

United States Patent [19]

Niinai et al.

[11] Patent Number: 5,160,876

[45] Date of Patent: Nov. 3, 1992

[54] METHOD OF PROTECTING ROTATING MACHINE

[76] Inventors: Yoshitaka Niinai, 2-5-1-305, Nagahori-cho, Katsuta-shi, Ibaraki-ken; Norihisa Sagawa, 3271-50, Nakane, both of Katsuta-shi, Ibaraki-ken; Yasuhiro Kawai, 712-1, Takaba, Katsuta-shi, Ibaraki-ken; Sadato Igarashi, 1549-4, Shirakata, Tokai-mura, Naka-gun, Ibaraki-ken; Hisanobu Ohyama, 1-6-10-103, Nagahori, Katsuta-shi, Ibaraki-ken, all of Japan

[21] Appl. No.: 627,903

[22] Filed: Dec. 14, 1990

Related U.S. Application Data

[63] Continuation of Ser. No. 404,397, Sep. 8, 1989, abandoned.

[30] Foreign Application Priority Data

Sep. 9, 1988 [JP] Japan ..... 63-226763

[51] Int. Cl.[5] ..... B04B 13/00

[52] U.S. Cl. ..... 318/460; 388/925

[58] Field of Search ..... 318/126, 127, 128, 460; 388/924, 925

[56] References Cited

U.S. PATENT DOCUMENTS

| | | | |
|---|---|---|---|
| 2,461,643 | 2/1949 | Hemmeter | 318/460 X |
| 2,461,764 | 2/1949 | Olcott . | |
| 2,534,267 | 12/1950 | Kahn | 318/460 X |
| 2,534,268 | 12/1950 | Kahn et al. . | |
| 2,573,595 | 10/1951 | Oberg | 318/460 X |
| 2,878,937 | 3/1959 | Worst | 318/460 X |
| 2,963,159 | 12/1960 | Stone | 318/460 X |
| 3,195,034 | 7/1965 | Bensema | 318/460 X |
| 3,268,791 | 8/1966 | Burns et al. | 318/460 X |
| 3,281,551 | 10/1966 | Becke | 318/460 X |
| 3,398,346 | 8/1968 | Beck | 318/460 X |
| 3,513,375 | 5/1970 | Sellars | 318/460 X |
| 3,548,992 | 12/1970 | Dawson | 318/460 X |
| 3,681,661 | 8/1972 | Koegel | 318/460 X |
| 4,099,667 | 7/1978 | Uchida | 318/460 X |
| 4,977,510 | 12/1990 | Winzenz et al. | 364/463 |

FOREIGN PATENT DOCUMENTS 0082956 7/1983 Fed. Rep. of Germany .

*Primary Examiner*—Bentsu Ro

[57] ABSTRACT

A rotating machine including a rotating body connected to and driven by a drive unit via a drive shaft is protected by stopping rotation of the rotating body and drive shaft in response to a detected vibration amplitude exceeding a predetermined allowable value at two spaced time instants.

9 Claims, 2 Drawing Sheets

METHOD OF PROTECTING ROTATING MACHINE

This application is a continuation of application Ser. No. 07/404,397 filed Sep. 8, 1989, now abandoned.

BACKGROUND OF THE INVENTION

The present invention relates to a method of and apparatus for protecting a rotating machine such as a centrifuge including a rotating body or rotor rotating at high speed.

High-speed rotating machines such as centrifuges tend to produce a self-excited vibration when an excess clearance exists between rotating parts. Furthermore, a rotor of such machines is apt to be in an imbalanced state when a sample is inaccurately set by a user. Under such condition, the rotor of the machine oscillates at a large vibration amplitude and bearings for supporting the rotor are subjected to increased radial loads exerted thereon. To prevent damage or breakage of the bearings, it has been customary to detect the imbalance of the rotor, in terms of the amplitude of vibration of the rotor or a drive shaft connected to the rotor, so that rotation of the rotor is stopped when the detected amplitude of vibration exceeds a predetermined allowable value $A_0$ as at a point e shown in FIG. 3 of the accompanying drawings. The conventional practice is not satisfactory if the allowable value is set to a relatively low level because the detection of the amplitude of vibration of the rotor is greatly affected by external disturbances. This means that the detected vibration amplitude readily exceeds the low allowable value under the influence of the external disturbance, which causes frequent stopping of the rotor. On the other hand, an allowable value $A_0$ set at a high level permits the rotor to continue rotating while oscillating at an amplitude of vibration f which is slightly smaller than the allowable range $A_0$. Under such mode of operation, the bearing life is substantially reduced.

SUMMARY OF THE INVENTION

With the foregoing difficulties in view, an object of the present invention is to provide a method of and apparatus for precisely detecting the imbalance of a rotating body of a rotating machine without being adversely affected by external disturbances, to thereby protect the rotating machine from damage which may be caused by a bearing failure.

According to the present invention, there is provided a method of and apparatus for protecting a rotating machine including a rotating body connected to and driven by a drive unit via a drive of the type wherein the amplitude of vibration of one of the body and the drive shaft is detected. The drive unit is stopped when the detected amplitude of vibration exceeds a predetermined allowable value, characterized in that the allowable value must be exceeded at at least two spaced time instants. The speed of the drive unit is not affected by the vibration sensor sensing an amplitude less than the allowable value or the sensor sensing an allowable value at only one of the time instants. Different allowable values are provided. As the amplitude of the allowable values increases, the time separation between the spaced instants is in an inverse ratio to the amplitude of said allowable values.

With the combination of the allowable values and the corresponding periods of time provided for detection of the vibration amplitude at levels of the respective allowable values, detection of the vibration amplitude can be achieved precisely even when the body is subjected to external disturbances. Such precise detection closely follows the current bearing load condition and ensures that the rotating machine is stopped prior to being damaged due to a bearing failure.

Many other advantages and features of the present invention will become manifest to those versed in the art upon making reference to the detailed description and the accompanying sheets of drawings in which a preferred structural embodiment incorporating the principles of the present invention is shown by way of illustrative example.

DESCRIPTION OF THE PREFERRED EMBODIMENT

The present invention is describe in greater detail with reference to a preferred embodiment shown in the accompanying drawings.

Figure 2:
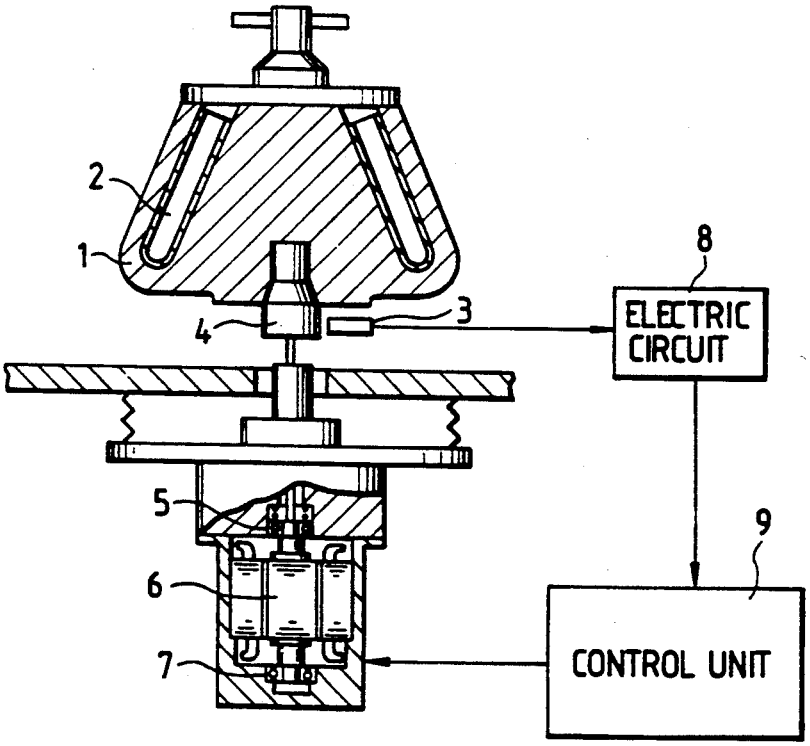
FIG. 2 is a cross-sectional view, with parts broken away for clarity, of a centrifuge associated with a safety device according to the present invention.
Figure 3:
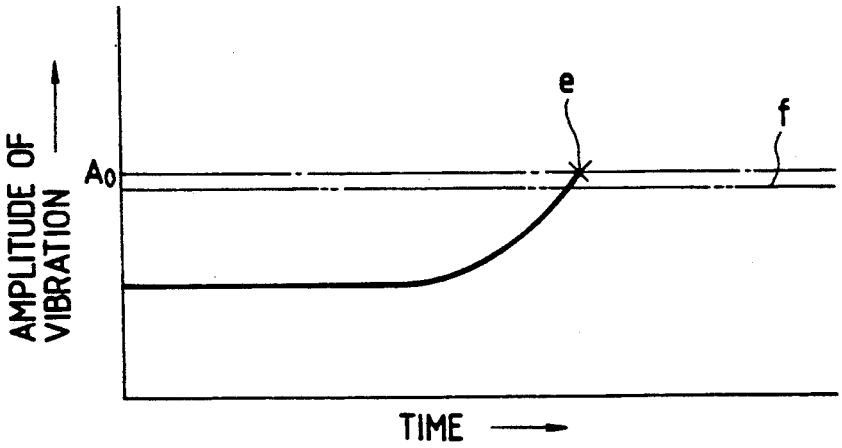
FIG. 3 PRIOR ART
FIG. 3 a graph similar to FIG. 1, but showing a conventional imbalance detection system.

As shown in FIG. 2, a rotating machine incorporating a safety device according to the present invention comprises a centrifuge including a rotating body or rotor 1 having plural cavities or wells 2 in which a sample is retained for centrifugal separation. Rotor 1 is mounted on one end of drive shaft 4, the other end of the drive shaft 4 being connected to the shaft of a motor 6. Drive shaft 4 and a rotor of motor 6 are rotatably supported by a pair of bearings 5 and 7. With this construction, rotor 1 is driven by motor 6 via drive shaft 4.

The safety device of the invention includes displacement sensor 3 such, for example, as an eddy current displacement sensor or a capacitance displacement sensor disposed in confrontation with drive shaft 4 for detecting the vibration amplitude of drive shaft 4. As an alternative, displacement sensor 3 may be disposed adjacent the periphery of rotor 1 for detecting the amount of imbalance of the rotor 1 in terms of the vibration amplitude of rotor 1. Displacement sensor 3 is connected with an electric circuit 8, in turn connected with a control unit 9 of the safety device.

Electric circuit 8 includes an analog/digital (A/D) converter for digitizing the analog output signal from displacement sensor 3 before the output signal is processed by control unit 9. Control unit 9 includes a microcomputer of the conventional type know per se comprising a central processing unit (CPU), a read only memory (ROM), a random access memory (RAM) and an input/output port (I/O), none shown. The microcomputer performs an arithmetic processing operation according to a program stored therein for calculating a control signal based on the vibration amplitude derived from displacement sensor 3. The thus-calculated control signal is supplied by controller 9 to drive unit 6 to control the drive unit so shaft 4 and rotor 1 are either at a predetermined, non-zero speed or stopped, i.e., unit 6 is deactivated.

In control unit 9, there are electrically stored three predetermined allowable values $A_1$, $A_2$ and $A_3$ (FIG. 1) for the vibration amplitude of drive shaft 4, and three predetermined time periods (t4–t1), (t3–t1) and (t2–t1) associated respectively with allowable values $A_1$, $A_2$ and $A_3$ for processing the detected vibration amplitude of drive shaft 4 to produce the control signal for drive unit 6. The lengths of time periods (t4–t1), (t3–t1) and (t2–t1) are inverse ratios to the largest of allowable values $A_1$ $A_2$ and $A_3$. This is because the service life of bearings 5, 7 is reduced with increased radial loads on the bearings 5, 7 (i.e., an increase in the vibration amplitude of drive shaft 3 and rotor 1), as evidenced by:

$$L_{10}=(C/P^p)\times 10^6$$

where $L_{10}$=total number of revolutions when a 10% rate of a group of apparently identical bearings if damaged, C=basic dynamic load rating (N) predicted for the respective bearing type, P=dynamic equivalent radial load (N), and p=3 for ball bearings and 10/3 for roller bearings.

From the foregoing equation, to avoid bearing failure, increasing vibration amplitudes of drive shaft 4 (i.e., a larger radial load on the bearings 5, 7) are detected over a shorter period of time.

The safety device of the foregoing construction operates as follows. The vibration amplitude of drive shaft 4 is detected by displacement sensor 3 while rotor 1 and drive shaft 4 are continuously rotated by drive unit 6. The output of sensor 3 is supplied by electric circuit 8 to control unit 9. When the vibration amplitude of drive shaft 4 is greater than the first allowable value $A_1$ and smaller than the second allowable value $A_2$, as indicated by the thick solid line in FIG. 1, control unit 9 determines whether the detected vibration amplitude is still present when the first period of time (t4–t1) lapses. If yes, when the first time period lapses (indicated by point a), control unit 9 derives a control signal to drive unit 6 to deactivate the same, thereby stopping rotation of rotor 1. Conversely, if the solid-lined detected vibration amplitude is not present at time a, control unit 9 issues a control signal to allow continued rotation of rotor 1.

Figure 1:
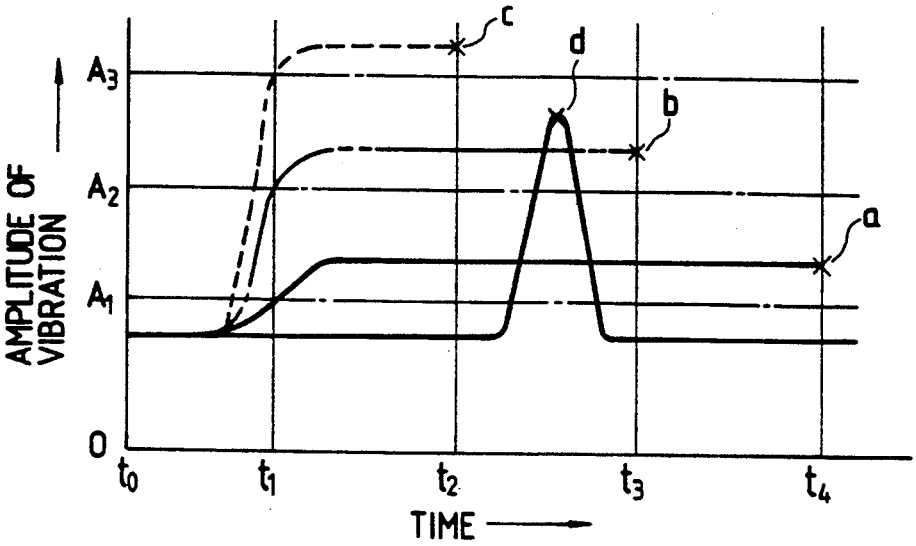
FIG. 1 is a graphical representation of the relation between the vibration amplitude of a drive shaft and detection time of vibration amplitude to indicate how drive shaft imbalance is detected to protect a rotating machine according to the present invention.

When the detected vibration amplitude is in a range between the second and third allowable values $A_2$ and $A_3$, as indicated by the dash-and-dots line in FIG. 1, control unit 9 determines whether the detected vibration amplitude between $A_2$ and $A_3$ still appears when the second period of time (t3–t1) lapses. If yes, when the second time period lapses (indicated by the point b), control unit 9 supplies a control signal to drive unit 6 to deactivate the same. Thus, rotation of rotor 1 is terminated. If the detected vibration amplitude is not between $A_2$ and $A_3$ when the second time period lapses, rotation of rotor 1 is not interrupted.

Likewise, when the detected vibration amplitude is greater than the third allowable value $A_3$, as indicated by the broken line in FIG. 1, control unit 9 determines whether the detected vibration amplitude is greater than $A_3$ at the end of the third time period (t2–t1). If yes, when the third period of time lapses (indicated by the point c), control unit 9 supplies a control signal to drive unit 6 to stop rotation of rotor 1. Conversely, if the broken-lined detected vibration amplitude greater than $A_3$ is not present at time c, rotation of rotor 1 is not interrupted.

When the detected vibration amplitude is smaller than the first allowable value $A_1$, rotation of rotor 1 is not interrupted. However, if the detected vibration amplitude fluctuates due to an external disturbance and contains a peak value exceeding the second allowable value $A_2$ as indicated by d in FIG. 1, control unit 9 determines whether the peak value continues throughout the second period of time (t4–t2). Since the peak value d disappears before the second time period elapses (indicated by the point a), control unit 9 does not issue a control signal to deactivate drive unit 6. Accordingly, rotor 1 is continuously rotated.

With the foregoing combination of a plurality of predetermined allowable values and a corresponding number of different periods of time provided for detection of the vibration amplitude of the rotor or the drive shaft at levels of the respective allowable values, detection of the vibration amplitude can be achieved precisely without being influenced by external disturbance. This precise detection closely represents the current bearing load condition, so that the rotating machine can be protected from damage which may be caused by a bearing failure.

Obviously, various modifications and variations of the present invention are possible in the light of the above teaching. It is therefore to be understood that within the scope of the appended claims the invention may be practiced otherwise than as specifically described.

What is claimed is:

1. Apparatus for controlling a machine having a rotating part driven by a motor shaft comprising a vibration sensor for the rotating part for deriving a signal having an amplitude indicative of vibration of the part, a controller responsive to the amplitude vibration sensor for selectively stopping rotation of the shaft, the controller being arranged so that the shaft rotation is (a) stopped in response to the amplitude of the signal having a predetermined amplitude relation at first and second different displaced time instants and (b) not affected by the vibration sensor in response to (i) the amplitude being less than a predetermined value at one of said instants and (ii) the predetermined amplitude relation occurring at only one of said time instants.

2. The apparatus of claim 1 wherein the predetermined amplitude relation includes plural amplitude ranges, different second time instants being associated with each of said amplitude ranges, the displacement of the first and second time instants associated with the amplitude ranges being such that shorter displaced time instants are associated with larger amplitude ranges.

3. Apparatus for controlling a machine having a rotating part driven by a motor shaft comprising a vibration sensor for the rotating part for deriving a signal having an amplitude indicative of vibration of the part, a controller responsive to the amplitude vibration sensor for selectively stopping rotation of the shaft, the controller being arranged so that the shaft rotation is (a) stopped in response to the amplitude of the signal having a predetermined amplitude relation at first and second displaced time instants and (b) not affected by the vibration sensor in response to (i) the amplitude being less than a predetermined value at one of said instants or (ii) the predetermined amplitude relation occurring at only one of said time instants, the predetermined amplitude relation including plural amplitude ranges, different second time instants being associated with each of said amplitude ranges, the displacement of the first and second time instants associated with the amplitude ranges being such that shorter displaced time instants are associated with larger amplitude ranges, a first of the ranges being between $A_1$ and $A_2$, a second of the ranges being between $A_2$ and $A_3$ and a third range being in excess of $A_3$, where $A_1 \leqq A_2 \leqq A_3$, time displacements $(t_1-t_4)$, $(t_1-t_3)$ and $(t_1-t_2)$ between the first and second time instants being respectively associated with the first, second and third ranges, where $(t_1-t_4) \geqq (t_1-t_3) \geqq (t_1-t_2)$.

4. A method of controlling a machine having a rotating part driven by a motor shaft comprising sensing vibration of the rotating part, stopping rotation of the part in response to the amplitude of the sensed vibration having a predetermined amplitude relation at a pair of displaced first and second different time instants, and maintaining the rotating speed at a predetermined value in response to the sensed vibration (i) being less than a predetermined value at one of said instants and (ii) the predetermined amplitude relation occurring at only one of said time instants.

5. The method of claim 4 wherein the predetermined amplitude relation includes plural amplitude ranges, different second displaced time instants being associated with each of said amplitude ranges, the displacement of the first and second time instants associated with the amplitude ranges being such that shorter displaced time instants are associated with larger amplitude ranges.

6. A method of protecting a rotating machine including a rotating body connected to and driven by a drive unit via a drive shaft, comprising the steps of:

(a) activating the drive unit to rotate the drive shaft and the rotating body, the drive shaft and the rotating body vibrating with a vibrating amplitude while driven by the drive unit;

(b) detecting the vibration amplitude of the rotating body or the drive shaft while the rotating body and the drive shaft are rotating;

(c) comparing the thus-detected vibration amplitude with at least a first predetermined allowable value and a second predetermined allowable value larger than said first predetermined allowable value;

(d) in response to the detected vibration amplitude being initially in a first range between said first and second allowable values, detecting whether the detected vibration amplitude is still in the first range when a first predetermined period of time subsequent to the initial time of the amplitude detection elapses;

(e) in response to the detected vibration amplitude being initially greater than said second predetermined allowable value, detecting whether the detected vibration amplitude is still greater than the second allowable value when a second predetermined period of time which is shorter than said first predetermined time period and subsequent to the initial time of the amplitude detection elapses;

(f) deactivating the drive unit to stop rotation of the drive shaft and the rotating body in response to said detecting step (d) or (e) indicating the presence of the initially detected vibration amplitude; and (g) continuing activation of the drive unit so the drive shaft and the rotating body continue to rotate in response to the detected vibration amplitude being smaller than said first predetermined allowable value or in response to said detecting step (d) or (e) indicating the absence of the initially detected vibration amplitude.

7. The method of claim 6, wherein the lengths of said predetermined periods of time are in an inverse ratio to the amplitudes of said allowable values.

8. The method of claim 6, wherein the lengths of said first and second predetermined time periods are in an inverse ratio to the amplitudes of said first and second predetermined allowable values.

9. A method of controlling a machine having a rotating part driven by a motor shaft comprising sensing vibration of the rotating part, stopping rotation of the part in response to the amplitude of the sensed vibration having a predetermined amplitude relation at a pair of displaced first and second time instants, and maintaining the rotating speed at a predetermined value in response to the sensed vibration (i) being less than a predetermined value at one of said instants or (ii) the predetermined amplitude relation occurring at only one of said time instants, the predetermined amplitude relation including plural amplitude ranges, different second displaced time instants being associated with each of said amplitude ranges, the displacement of the first and second time instants associated with the amplitude ranges being such that shorter displaced time instants are associated with larger amplitude ranges, a first of the ranges being between $A_1$ and $A_2$, a second of the ranges being between $A_2$ $A_3$ and a third range being in excess of $A_3$, where $A_1 \leqq A_2 \leqq A_3$, the time displacements $(t_1-t_4)$, $(t_1-t_3)$ and $(t_1-t_2)$ between the first and second time instants being respectively associated with the first, second and third ranges, where $(t_1-t_4) \geqq (t_1-t_3) \geqq (t_1-t_2)$.

* * * * *

UNITED STATES PATENT AND TRADEMARK OFFICE

CERTIFICATE OF CORRECTION

PATENT NO. : 5,160,876

DATED : November 3, 1992

INVENTOR(S) : Yoshitaka Niinai et al.

It is certified that error appears in the above-identified patent and that said Letters Patent is hereby corrected as shown below:

On the title page, please add the Assignee's name as follows:

--Hitachi Koki Company, Limited, Japan--

Signed and Sealed this

Nineteenth Day of October, 1993

*Attest:*

*Attesting Officer*

Bruce Lehman

BRUCE LEHMAN

*Commissioner of Patents and Trademarks*